US006848495B2

(12) United States Patent
Edwards et al.

(10) Patent No.: US 6,848,495 B2
(45) Date of Patent: Feb. 1, 2005

(54) METHOD OF MANUFACTURING A LAMINATED ROTOR

(75) Inventors: Jerry D. Edwards, Bristol, VA (US); David T. Monk, Bristol, VA (US); John W. Tolbert, Bristol, TN (US)

(73) Assignee: Bristol Compressors, Inc., Bristol, VA (US)

( * ) Notice: Subject to any disclaimer, the term of this patent is extended or adjusted under 35 U.S.C. 154(b) by 0 days.

(21) Appl. No.: 10/440,935

(22) Filed: May 19, 2003

(65) Prior Publication Data

US 2004/0231818 A1 Nov. 25, 2004

(51) Int. Cl.[7] ..... B22D 17/00; B22D 19/00
(52) U.S. Cl. ..... 164/109; 164/113
(58) Field of Search ..... 164/108–110, 113

(56) References Cited

U.S. PATENT DOCUMENTS

| | | | | |
|---|---|---|---|---|
| 854,760 | A | 5/1907 | Reist | |
| 5,097,166 | A | 3/1992 | Mikulic | |
| 5,161,597 | A | 11/1992 | Dohogne | |
| 5,429,175 | A | 7/1995 | Thieman et al. | |
| 5,488,984 | A | 2/1996 | Fahy | |
| 5,829,120 | A | 11/1998 | Uchida et al. | |
| 5,887,643 | A | 3/1999 | Nakamura et al. | |
| 5,990,595 | A | 11/1999 | Crowell | |
| 5,992,003 | A | 11/1999 | Elliott et al. | |
| 6,031,312 | A | 2/2000 | Zoche et al. | |
| 6,092,277 | A | 7/2000 | Beltowski et al. | |
| 6,159,305 | A | 12/2000 | Kliman et al. | |
| 6,345,433 | B1 | 2/2002 | Kliman et al. | |
| 6,455,100 | B1 * | 9/2002 | Heimann et al. | 427/104 |
| 2002/0153802 | A1 | 10/2002 | Kilman et al. | |

FOREIGN PATENT DOCUMENTS

| | | | |
|---|---|---|---|
| JP | 59-107760 | A | 6/1984 |
| JP | 63-314152 | A | 12/1988 |
| JP | 1-109029 | A | 4/1989 |
| JP | 10-147828 | A | 6/1998 |
| JP | 2001-009560 | A | 1/2001 |
| JP | 2001-268858 | A | 9/2001 |
| JP | 2001-346348 | A | 12/2001 |
| KR | 9603204 | B1 | 3/1996 |

* cited by examiner

*Primary Examiner*—Kuang Y. Lin
(74) *Attorney, Agent, or Firm*—Brian T. Sattizahn; McNees Wallace & Nurick LLC

(57) ABSTRACT

A method of assembling and manufacturing a laminated rotor is provided which uses laminations having a thin bridge thickness. Different techniques are provided for preventing the molten material used in the casting or injection molding operation from leaking or seeping between the laminations during casting. In one technique, the laminations are stacked and oriented in the conventional way, and then both axial and radial pressures are applied to the stacked laminations to hold the laminations in position for the casting process. In another technique, the laminations are formed or extruded with a lip or collar portion that fit in a countersunk portion of an adjacent lamination and forms a wall or barrier between the laminations to prevent the leakage of the molten material during the casting or injection molding operation.

13 Claims, 3 Drawing Sheets

METHOD OF MANUFACTURING A LAMINATED ROTOR

BACKGROUND OF THE INVENTION

The present invention relates generally to a method of manufacturing a laminated rotor for a motor. More specifically, the present invention is related to methods of manufacturing a laminated rotor with laminations having a desired rotor bridge thickness prior to the assembly of the laminated rotor core.

A squirrel cage rotor for use in an induction motor has a rotor core and a rotor cage that extends through the rotor core and is connected together at each end of the rotor core by end rings. The rotor core is typically made of a magnetic material such as iron or steel and the rotor cage is typically made of an electrically conductive material such as copper, aluminum or an aluminum alloy. The rotor core has a substantially cylindrical shape with a longitudinally extending central bore to receive the shaft of the motor and a plurality of longitudinally extending rotor slots or apertures, which rotor slots may be slightly skewed, to receive corresponding rotor bars of the rotor cage. A laminated rotor core is commonly manufactured or formed by stacking or assembling a plurality of discs or laminations of the magnetic material on top of each other until the desired substantially cylindrical shape is obtained. During the stacking or assembling process, the laminations are also aligned or oriented into their proper position. Alternatively, the rotor core can be manufactured from a single piece of the magnetic material, but this technique is less common.

Each lamination in the rotor core is formed or extruded to a pre-selected thickness, shape and configuration. The preselected configuration of the laminations includes an aperture for the central bore, a plurality of apertures for the rotor slots positioned equidistantly about the central bore and a predetermined bridge thickness, which bridge thickness is defined as the radial distance between the outer circumference of the lamination and the aperture for the rotor slot. The dimensioning of the bridge thickness is important because the bridge thickness of the rotor is related to the motor's performance, wherein a thinner bridge thickness provides better performance. The pre-selected configuration of the lamination can also include other features as needed. As the laminations are stacked to form the rotor core, they are aligned and/or oriented into an appropriate position to form substantially continuous apertures in the rotor core and, if necessary, other desired features of the rotor core.

Next, the rotor cage is manufactured or formed by positioning or disposing a rotor bar into each of the plurality of rotor slots in the rotor core, which rotor bars extend to at least the ends of the rotor slots, and connecting the adjacent ends of the rotor bars to each other with an end ring. In one technique, the stacked laminations forming the rotor core can be welded together and/or axially compressed to fix their position and can then be placed in a mold. Once in the mold, the rotor bars, and possibly the rings, can then be formed by die casting or injection molding molten aluminum (or other suitable material), under high pressure, directly into the rotor slots and possibly into molds for the end rings. Alternatively, the rotor bars can be placed or positioned in the rotor slots using any suitable technique and can then be connected together by attaching or connecting a ring to each end of the rotor bars using any suitable technique such as brazing. It should be noted that if the end rings are not cast during the casting process, the end rings can be connected or attached using the brazing technique described above.

One potential problem with casting the rotor bars into the laminated rotor core is that additional steps have to be taken to prevent the molten casting material, e.g. molten aluminum, from leaking or seeping between the laminations. To prevent the molten casting material from leaking or seeping between the laminations, the laminations are typically formed or extruded with a greater than desired outer diameter or bridge thickness and are welded together or compressed axially as discussed above. When these additional steps are performed, both the inner diameter and outer diameter of the laminated rotor have to be subsequently machined or processed after the casting process to obtain the desired inner diameter, outer diameter and bridge thickness for the laminated rotor.

Therefore, what is needed are techniques for manufacturing a laminated rotor with laminations having an outer diameter and/or bridge thickness that restricts the molten material cast into the rotor core from leaking or seeping out between the laminations during the casting process.

SUMMARY OF THE INVENTION

One embodiment of the present invention is directed to a method of manufacturing a laminated rotor for a motor. The method of manufacturing including the step of providing a plurality of laminations. Each lamination of the plurality of laminations having a plurality of rotor slots and a preselected bridge thickness. The preselected bridge thickness is selected to provide optimal motor performance. Next, the plurality of laminations are assembled into a laminated rotor core and both axial and radial forces are applied to the laminated rotor core to secure the laminated rotor core in a fixed position. Finally, a molten material is introduced into each of the plurality of rotor slots to form a plurality of rotor bars, wherein the axial and radial forces applied to the laminated rotor core prevent the molten material from leaking between assembled laminations.

Another embodiment of the present invention is directed to a method of manufacturing a laminated rotor for a motor. The method of manufacturing includes the step of providing a plurality of laminations. Each lamination of the plurality of laminations having a first planar surface, a second planar surface opposite the first planar surface and a bridge thickness providing optimal motor performance. Each lamination of the plurality of laminations including a plurality of rotor slots, a plurality of countersink portions disposed in the first planar surface, and a plurality of collar portions disposed on the second planar surface. Each rotor slot of the plurality of rotor slots has a corresponding countersink portion and a corresponding collar portion. The next step is assembling the plurality of laminations into a laminated rotor core, wherein the plurality of collar portions of one lamination fit in the plurality of countersink portions of an adjacent lamination. A force is applied to the laminated rotor core to secure the laminated rotor core in a fixed position. Finally, a molten material is cast into each of the plurality of rotor slots to form a plurality of rotor bars, wherein the countersink portion and the collar portion of adjacent laminations prevent the molten material from leaking between assembled laminations.

A further embodiment of the present invention is directed to a rotor core lamination for a laminated rotor. The lamination includes a substantially cylindrical body having a central axis and an outer circumference. The substantially cylindrical body also has a first planar surface and a second planar surface opposite the first planar surface. The lamination also includes a plurality of apertures disposed between the central axis and the outer circumference of the substantially cylindrical body. The plurality of apertures extend from the first planar surface to the second planar surface. The lamination further includes a plurality of channels disposed in the first planar surface of the substantially cylindrical body and a plurality of collar portions extending away from the second planar surface of the substantially cylindrical body. Each channel of the plurality of channels being disposed adjacent to a corresponding aperture and each collar portion of the plurality of collar portions being disposed adjacent to a corresponding aperture. Finally, each collar portion of the plurality of collar portions is configured and disposed to fit within a corresponding channel of the plurality of channels of another lamination upon assembly of the lamination in the laminated rotor.

One advantage of the present invention is that a laminated rotor can be manufactured with laminations having the desired outer diameter and/or bridge thickness without the need for a subsequent machining operation.

Another advantage of the present invention is that the rotor manufacturing process is more economical and efficient because expensive and laborious machining processes are eliminated.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to refer to the same or like parts.

DETAILED DESCRIPTION OF THE INVENTION

Figure 1:
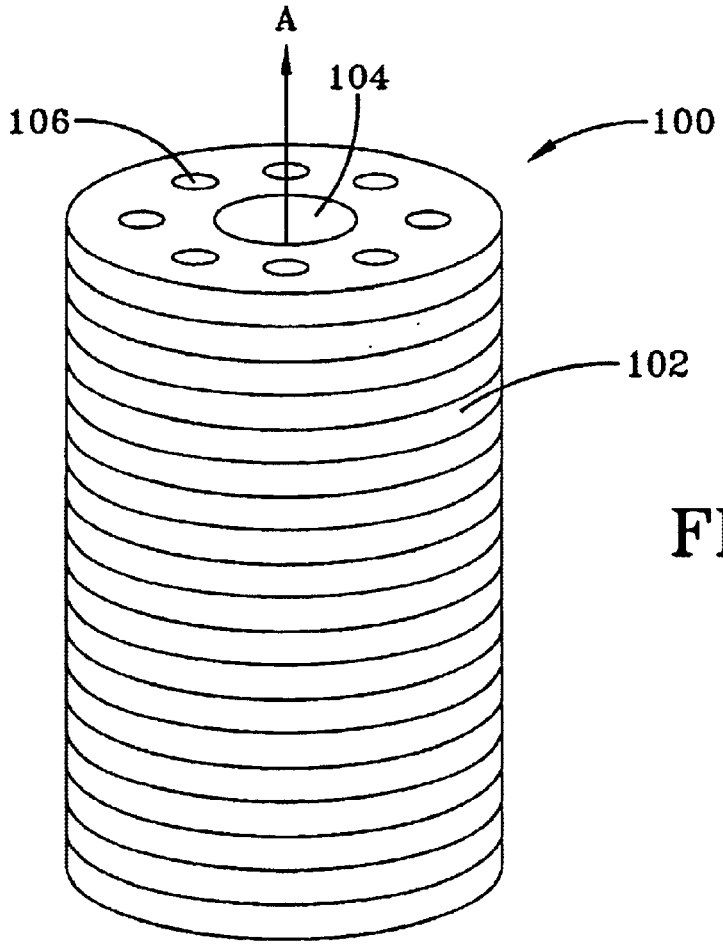
FIG. 1 illustrates a perspective view of a laminated rotor core for use with the present invention.

FIG. 1 illustrates a laminated rotor core 100 for use with the present invention. The laminated rotor core 100 is preferably used in a squirrel cage rotor of an induction motor for a compressor. The laminated rotor core 100 is formed or assembled by stacking a plurality of laminations 102. The number of laminations required to assemble the laminated rotor core 100 is dependent upon the thickness of the laminations 102 and the desired height of the laminated rotor core 100. In one embodiment of the present invention, the thickness of the laminations can range from about 0.015 inches to about 0.025 inches and is preferably 0.022 inches thick for a standard application and 0.018 inches thick for a "low loss" application.

Figure 2:
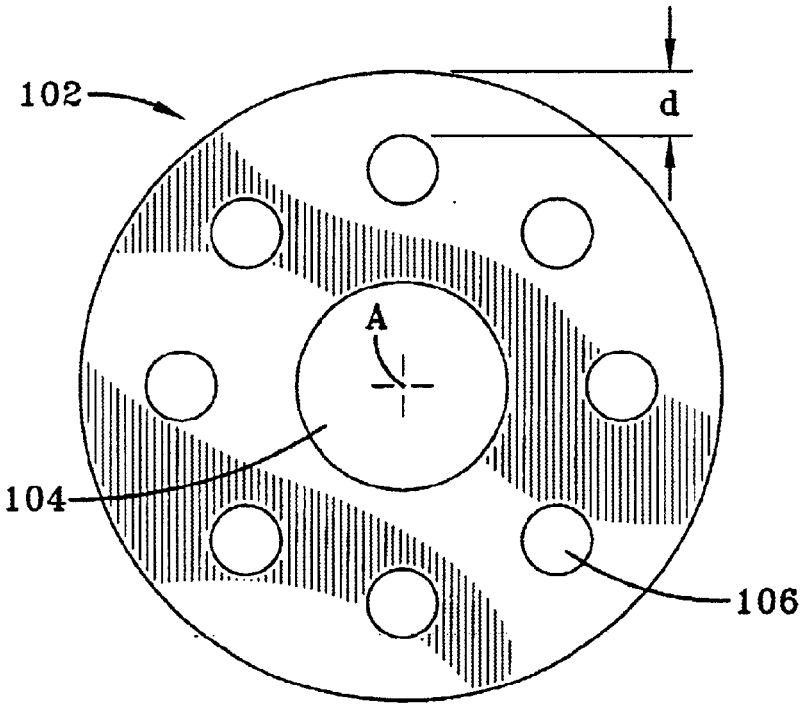
FIG. 2 illustrates a top view of a lamination from the laminated rotor core of FIG. 1.

FIG. 2 illustrates a top view of a lamination 102. Each lamination 102 that is assembled into the laminated rotor core 100 preferably has a central aperture or bore 104. The central bore 104 of the laminated rotor core 100 is configured to receive the shaft of the motor upon complete assembly of the motor. In addition, each lamination 102 preferably has a plurality of rotor slots or apertures 106. The rotor slots 106 are preferably completely enclosed by the outer circumference of the laminated rotor core 100, i.e., they are closed rotor slots. It is to be understood that apertures 106, while being referred to as rotor slots and shown as circular apertures in the Figures can have any desired shape including oval, circular, rectangular, irregular or any other suitable shape. The plurality of rotor slots 106 are positioned circumferentially about the center axis A of the lamination 102. The plurality of rotor slots 106 are preferably positioned equidistant and/or equiangular to one another about the axis A. The shape, number and size of the rotor slots 106 are dependent on the particular configuration of the motor and rotor cage used. In one embodiment of the present invention, the number of rotor slots (and bars) can range from about 20 to about 40 and is preferably 34 bars for a high torque application and 28 bars for a high performance application.

Furthermore, each rotor slot 106 is positioned a distance "d" from the outer circumference of the lamination 102. The distance "d" corresponds directly to the bridge thickness of the lamination 102 and laminated rotor core 100. To obtain optimal motor performance, the bridge thickness "d" should be as small or thin as possible while still maintaining the structural integrity of the rotor during operation of the motor. For example, for a laminated rotor core 100 having an outer diameter of 2.6 inches, the bridge thickness is preferably between about 0.01 inches and about 0.02 inches wide. The preferred bridge thickness "d" can vary depending on the configuration and size of the motor. Finally, it is to be understood that the lamination 102 can include additional features which are not shown for simplicity.

The laminations 102 are preferably formed from a magnetic material such as iron or steel by an extrusion or pressing operation of one or more steps. Once the extrusion operation is complete, the laminations 102 will preferably have a top view similar to the top view of FIG. 2. After the laminations 102 are extruded, they are stacked or assembled to obtain the laminated rotor core 100. During the assembly operation, the laminations 102 are preferably aligned and/or oriented to obtain a laminated rotor core 100 and to obtain rotor slots 106 which extend substantially longitudinally and coaxially through the laminated rotor core 100, i.e., the rotor slots 106 have a skew of 0 degrees. In another preferred embodiment, the laminations 102 can be oriented to obtain rotor slots 106 that extend longitudinally through the laminated rotor core 100 with a skew of 2–15 degrees and preferably between about 412 degrees. The embodiment of the laminated rotor core 100 that does not have a skew of the rotor slots 106 can be used for a three phase application and the embodiment of the laminated rotor core 100 that has a skew of the rotor slots 106 can be used for a single phase application.

In a preferred embodiment of one process of the present invention, laminations 102 are formed or extruded with a bridge thickness "d" that provides for optimal performance of the motor, and are then assembled together to form the laminated rotor core 100. The laminated rotor core 100 is placed in a mold of a casting or injection molding apparatus (not shown). Once the laminated rotor core 100 is placed in the mold, both radial forces and pressure and axial forces and pressure are applied to the laminated rotor core 100 by the mold and/or casting or injection molding apparatus to hold or secure the laminated rotor core 100 in position for the casting or injection molding operation and to prevent the molten material used in the casting or injection molding process, preferably aluminum or aluminum alloy, from leaking or seeping between the stacked laminations 102 of the laminated rotor core 100. Upon being secured in the mold of the casting or injection molding apparatus, the laminated rotor core 100 is now ready for the commencement of the casting or injection molding operation to manufacture some or all of the rotor cage. The casting or injection molding apparatus includes a system or device for casting, injecting or introducing the rotor bars into the rotor slots 106 of the laminated rotor core 100 and preferably a mold or cast for casting, injecting or introducing end rings to connect the ends of the rotor bars. The application of both the radial and axial forces to the laminated rotor core 100 during the casting or injection molding operation prevents the leaking or seeping of the molten material between the stacked laminations 102 even though the laminations 102 and laminated rotor core 100 have a "thin" bridge thickness "d" for optimal performance of the motor.

Figure 3:
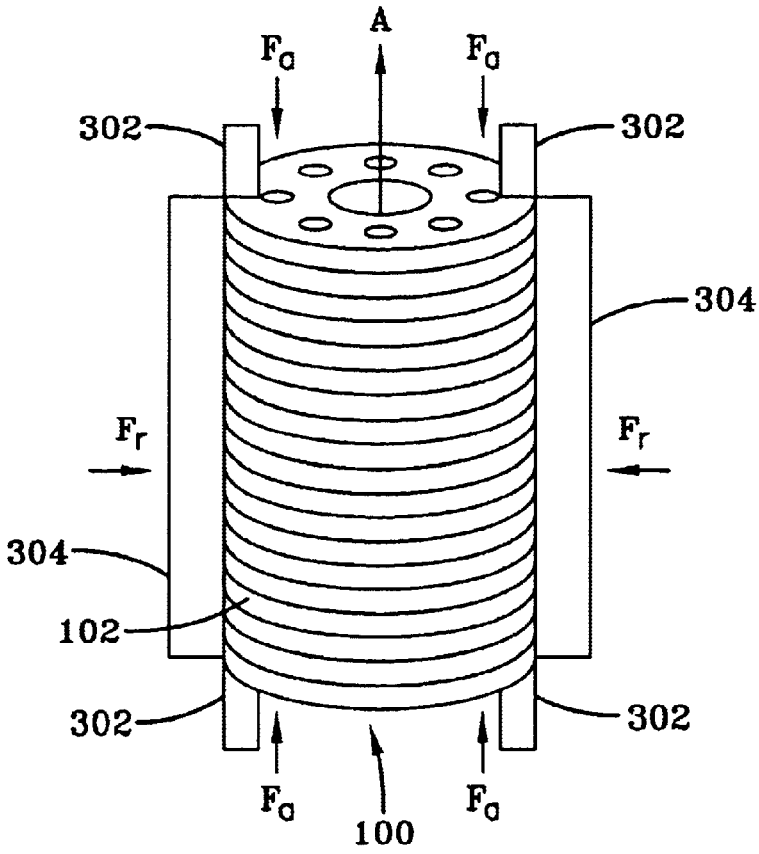
FIG. 3 illustrates schematically the force applying members in one embodiment of the present invention.
Figure 4:
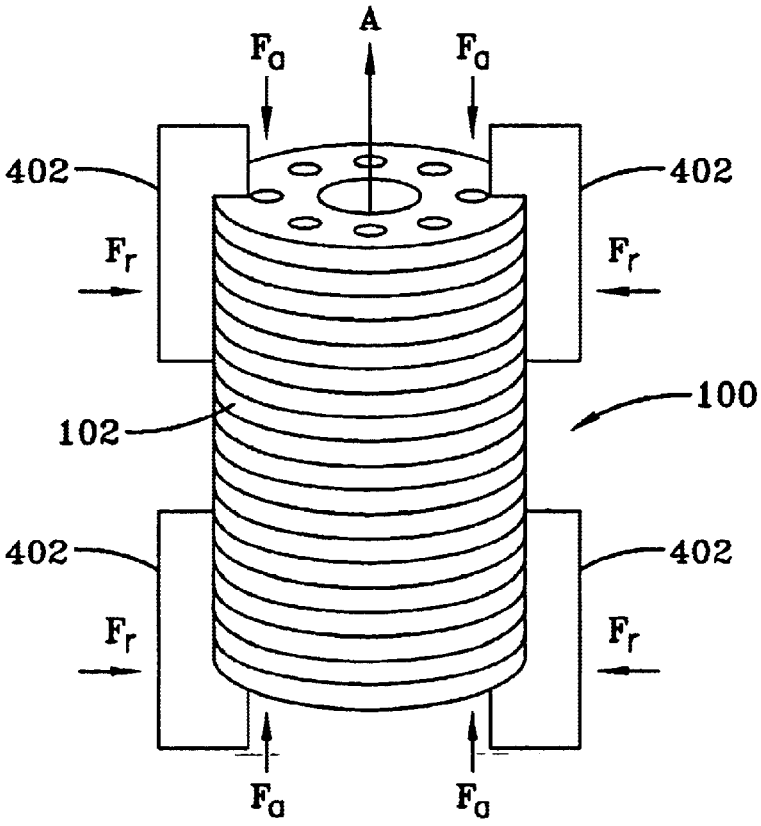
FIG. 4 illustrates schematically the force applying members in another embodiment of the present invention.

FIGS. 3 and 4 illustrate schematically two embodiments for applying the axial and radial forces to the laminated rotor core 100. In FIG. 3, the laminated rotor core 100 is held in position by one or more axial force members 302 and one or more radial force members 304. The axial force members 302 are configured and disposed to apply an axial force $F_A$, as shown in FIG. 3, to the top and bottom of the laminated rotor core 100 to axially compress the laminated rotor core 100 and laminations 102 without interfering with the casting operation. In addition, the axial force members 302 are configured and disposed to preferably apply the axial force $F_A$ about substantially the entire circumference of the laminated rotor core 100, although the axial force $F_A$ can be applied to selected segments of the laminated rotor core 100. Similarly, the radial force members 304 are configured and disposed to apply a radial force $F_R$, as shown in FIG. 3, to the sides or outer perimeter of the laminated rotor core 100 to radially compress the laminated rotor core 100 and laminations 102 without interfering with the casting operation. In addition, the radial force members 304 are configured and disposed to preferably apply the radial force $F_R$ about substantially the entire outer perimeter of the laminated rotor core 100, although the radial force $F_R$ can be applied to selected segments of the laminated rotor core 100.

In FIG. 4, the laminated rotor core 100 is held in position by two or more "L"-shaped force members 402. The "L"-shaped force members 402 are configured and disposed to apply both an axial force $F_A$, as shown in FIG. 4, to the top and bottom of the laminated rotor core 100 to axially compress the laminated rotor core 100 and laminations 102 without interfering with the casting operation and to apply a radial force $F_R$, as shown in FIG. 4, to the sides or outer perimeter of the laminated rotor core 100 to radially compress the laminated rotor core 100 and laminations 102 without interfering with the casting operation. In addition, the "L"-shaped force members 402 are configured and disposed to preferably apply the axial force $F_A$ and the radial force $F_R$ about substantially the entire circumference and outer perimeter of the laminated rotor core 100, although the axial force $F_A$ and the radial force $F_R$ can be applied to selected segments of the laminated rotor core 100.

In this embodiment of the present invention, any suitable type of casting or injection molding apparatus and/or mold can be used for the casting or injection molding of the rotor cage so long as the casting or injection molding apparatus and/or mold can apply both an axial force or pressure and a radial force or pressure to the laminated rotor core at the same time during the casting operation. Finally, while not described herein, the remaining process steps for the manufacture of the rotor and motor would be completed as is well known in the art.

Figure 5:
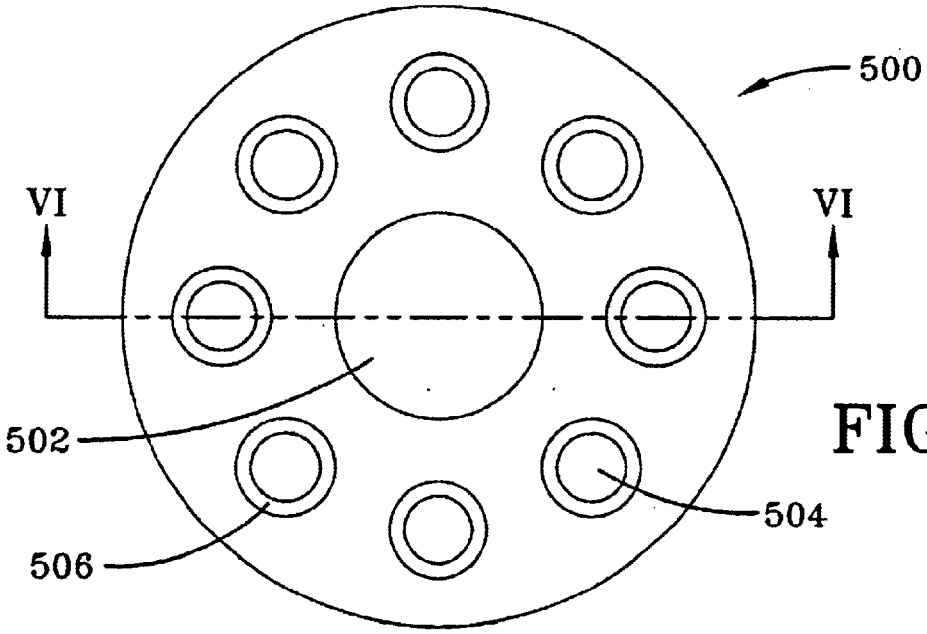
FIG. 5 illustrates a top view of a lamination in another embodiment of the present invention.
Figure 6:
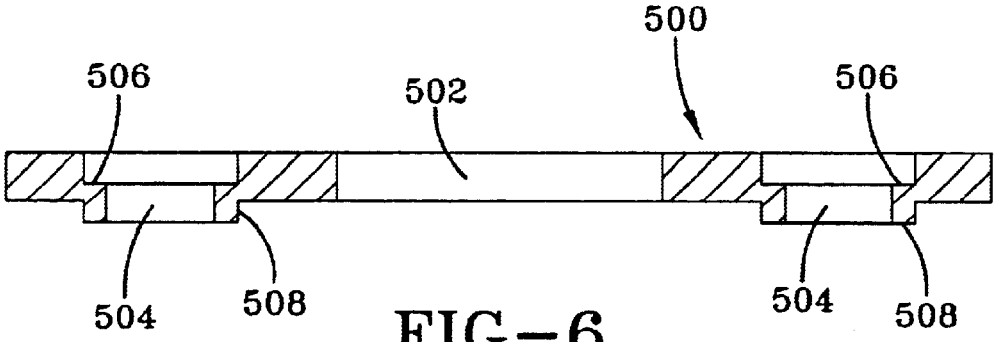
FIG. 6 illustrates a cross-sectional view of the lamination of FIG. 5 taken along line VI—VI in FIG. 5.
Figure 7:
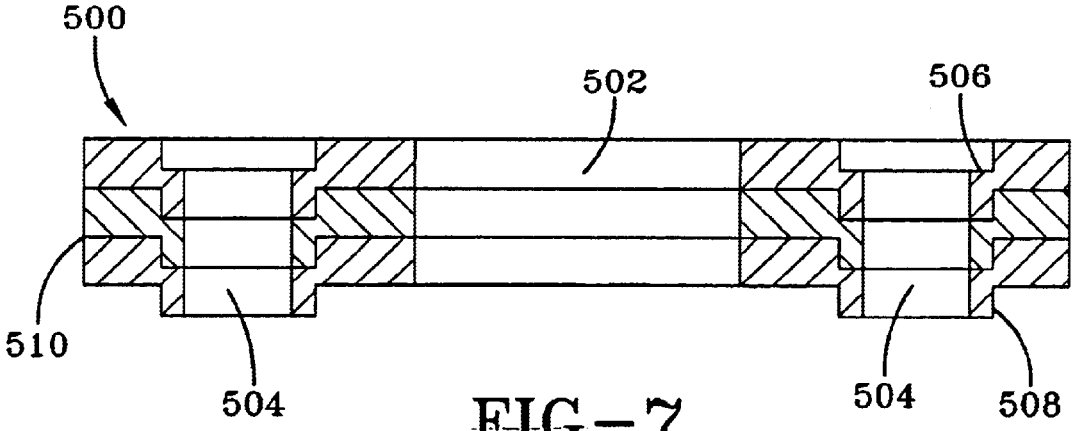
FIG. 7 illustrates a cross sectional view of several laminations of FIGS. 5 and 6 assembled together.

In another preferred embodiment of the present invention, the laminated rotor core 100 is assembled using the laminations shown in FIGS. 5–7. FIG. 5 illustrates a top view of the lamination 500 of this embodiment of the present invention. As shown in FIG. 5, lamination 500 has a central bore 502 and a plurality of rotor slots 504, similar to the lamination 102 described above. However, in contrast to the lamination 102 of FIG. 2, the lamination 500, as shown in greater detail in FIG. 6, has a countersink or groove portion 506 and a collar or lip portion 508 adjacent to each rotor slot 504. The countersink portion 506 is preferably disposed on one planar side of the lamination 500 and is preferably a channel or groove in the side of the lamination 500 that is open to the rotor slot 504 and substantially circumferentially encloses or surrounds the rotor slot 504. The collar portion 508 is disposed opposite the countersink portion 506 on the other planar side of the lamination 500 and is preferably an extension or projection extending from the other planar side and circumferentially enclosing or surrounding the rotor slot 504. Preferably, the countersink portion 506 and the collar portion 508 are substantially coaxial to the center axis of the rotor slot 504.

As shown in FIG. 7, when assembling the laminated rotor core 100 with laminations 500, the collar portions 508 of each lamination 500 are preferably configured to mate with or fit in the countersink portions 506 of adjacent laminations 500, such that an interference fit or connection is formed between the two. The countersink portions 506 and the collar portions 508 are preferably configured and disposed on the lamination 500 such that a substantially cylindrical rotor slot 504 is produced as shown in FIG. 7, which rotor slot 504 is similar to the rotor slot 106 of lamination 102. When assembled, the countersink portion 506 and the collar portion 508 form a liquid barrier between a spacing 510 between the laminations 500 and the rotor slots 504. The liquid barrier formed by the countersink portion 506 and the collar portion 508 is used to prevent the molten material used to cast the rotor bars from leaking or seeping between the laminations 500 during the casting operation.

While the countersink portion 506 and the collar portion 508 are shown with surfaces that are substantially parallel or perpendicular to the central axis of the rotor slot 504, the surfaces of the countersink portion 506 and the collar portion 508 can have any type of surface including angled or curved surfaces so long as the countersink portion 506 and the collar portion 508 can be fit together to form an interference fit and the rotor slot 504 is not altered. Furthermore, the depth of the countersink portion 506 is substantially equal to the height of the collar portion 508. However, it should be noted that slight differences in the depth and height of the countersink portion 506 and the collar portion 508 may be accommodated for in the casting operation when the laminated rotor core 100 is axially compressed. In a preferred embodiment of the present invention, the height of the collar portion 508 (or the depth of the countersink portion 506) is between about 10% and about 30% of the thickness of the lamination.

The process of manufacturing a laminated rotor core 100 with laminations 500 will now be described. To begin, laminations 500 are produced by an extrusion or stamping process with a bridge thickness "d" that provides for optimal performance of the motor, and then the laminations 500 are assembled together to form a laminated rotor core 100. The laminated rotor core 100 is positioned in a mold of a casting or injection molding apparatus (not shown) and secured or held in place. The securing and holding of the laminated rotor core 100 can be accomplished using techniques that are known in the art or by the technique described above that applies both radial forces and pressure and axial forces and pressure are applied to the laminated rotor core 100. Upon being secured in the mold of the casting or injection molding apparatus, the laminated rotor core 100 is now ready for the commencement of the casting or injection molding operation to manufacture some or all of the rotor cage. The casting or injection molding apparatus includes a system or device for casting, injecting or introducing the rotor bars into the rotor slots 504 of the laminated rotor core 100 and preferably a mold or cast for casting or injection molding end rings to connect the ends of the rotor bars. The presence of the countersink portions 506 and the collar portions 508 form a barrier in the rotor slots 504 to prevent the leaking or seeping of the molten material from between the stacked laminations 502 even though the laminations 502 and laminated rotor core 100 have a "thin" bridge thickness for optimal performance of the motor.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A method of manufacturing a laminated rotor for a motor, the method of manufacturing comprising the steps of:

providing a plurality of laminations, each lamination of the plurality of laminations having a plurality of rotor slots and a preselected bridge thickness, wherein the preselected bridge thickness is selected to provide optimal motor performance;

assembling the plurality of laminations to form a laminated rotor core;

applying both axial and radial forces to the laminated rotor core to secure the laminated rotor core in a fixed position; and introducing a molten material into the plurality of rotor slots of the plurality of laminations to form a plurality of rotor bars, while the axial and radial force are applied to the laminated rotor core for preventing the molten material from leaking between assembled laminations.

2. The method of claim 1 wherein the step of assembling the plurality of laminations comprises the step of aligning the plurality of laminations to form a plurality of longitudinally extending rotor slots in the laminated rotor core.

3. The method of claim 2 wherein the step of aligning the plurality of laminations comprises the step of aligning the plurality of laminations to form a plurality of longitudinally extending rotor slots in the laminated rotor core having a predetermined skew.

4. The method of claim 3 wherein the predetermined skew is between about 4 and about 12 degrees.

5. The method of claim 1 wherein the step of casting a molten material into the plurality of rotor slots comprises the step of casting a molten aluminum or aluminum alloy into the plurality of rotor slots.

6. The method of claim 1 wherein the step of applying both axial and radial forces to the laminated rotor core comprises the steps of:

applying the axial force to the laminated rotor core with a first mechanism; and applying the radial force to the laminated rotor core with a second mechanism, wherein the second mechanism is separate from the first mechanism.

7. The method of claim 1 wherein the step of applying both axial and radial forces to the laminated rotor core comprises the steps of:

applying the axial force to the laminated rotor core with a force member; and applying the radial force to the laminated rotor core with the force member, wherein the force member is configured to apply both the axial force and the radial force to the laminated rotor core.

8. A method of manufacturing a laminated rotor for a motor, the method of manufacturing comprising the steps of:

providing a plurality of laminations, each lamination of the plurality of laminations having a first planar surface, a second planar surface opposite the first planar surface and a bridge thickness providing optimal motor performance, each lamination of the plurality of laminations comprising a plurality of rotor slots, a plurality of countersink portions disposed in the first planar surface, and a plurality of collar portions disposed on the second planar surface, wherein each rotor slot of the plurality of rotor slots has a corresponding countersink portion and a corresponding collar portion;

assembling the plurality of laminations to form a laminated rotor core, wherein the plurality of collar portions of one lamination fit in the plurality of countersink portions of an adjacent lamination;

applying a force to the laminated rotor core to secure the laminated rotor core in a fixed position; and introducing a molten material into each of the plurality of rotor slots to form a plurality of rotor bars while the force is applied to the laminated rotor core, wherein the plurality of countersink portions and the plurality of collar portions of adjacent laminations form a barrier to prevent the molten material from leaking between assembled laminations.

9. The method of claim 8 wherein the step of assembling the plurality of laminations comprises the step of aligning the plurality of laminations to form a plurality of longitudinally extending rotor slots in the laminated rotor core.

10. The method of claim 9 wherein the step of aligning the plurality of laminations comprises the step of aligning the plurality of laminations to form a plurality of longitudinally extending rotor slots in the laminated rotor core having a predetermined skew.

11. The method of claim 10 wherein the predetermined skew is between about 4 and about 12 degrees.

12. The method of claim 8 wherein the step of casting a molten material into the plurality of rotor slots comprises the step of casting a molten aluminum or aluminum alloy into the plurality of rotor slots.

13. The method of claim 8 wherein the step of applying a force to the laminated rotor core comprises the step of applying both axial and radial forces to the laminated rotor core in the mold to secure the laminated rotor core in a fixed position.

* * * * *

UNITED STATES PATENT AND TRADEMARK OFFICE

CERTIFICATE OF CORRECTION

PATENT NO. : 6,848,495 B2
DATED : May 19, 2003
INVENTOR(S) : Edwards et al.

It is certified that error appears in the above-identified patent and that said Letters Patent is hereby corrected as shown below:

Column 4,
Line 45, before "laminated rotor core 100" add the following:
-- central bore 104 which extends substantially longitudinally and coaxially through the --.
Line 52, "412" should be -- 4 - 12 --.

Column 7,
Line 51, "force" should be -- forces --.

Signed and Sealed this

Sixteenth Day of August, 2005

JON W. DUDAS
*Director of the United States Patent and Trademark Office*

UNITED STATES PATENT AND TRADEMARK OFFICE

CERTIFICATE OF CORRECTION

PATENT NO. : 6,848,495 B2
DATED : February 1, 2005
INVENTOR(S) : Edwards et al.

It is certified that error appears in the above-identified patent and that said Letters Patent is hereby corrected as shown below:

Column 4,
Line 45, before "laminated rotor core 100" add the following:
-- central bore 104 which extends substantially longitudinally and coaxially through the --.
Line 52, "412" should be -- 4 - 12 --.

Column 7,
Line 51, "force" should be -- forces --.

This cerificate supersedes Certificate of Correction issued August 16, 2005.

Signed and Sealed this

Eighteenth Day of October, 2005

JON W. DUDAS
*Director of the United States Patent and Trademark Office*